US011168904B2

(12) United States Patent
Wang et al.

(10) Patent No.: US 11,168,904 B2
(45) Date of Patent: Nov. 9, 2021

(54) UNITARY AIR CONDITIONING SYSTEM WITH TEMPERATURE AND HUMIDITY COUPLED CONTROL AND METHOD OF USE

(71) Applicant: SHANGHAI JIAO TONG UNIVERSITY, Shanghai (CN)

(72) Inventors: Ruzhu Wang, Shanghai (CN); Yaodong Tu, Shanghai (CN); Tianshu Ge, Shanghai (CN)

(73) Assignee: SHANGHAI JIAO TONG UNIVERSITY, Shanghai (CN)

( * ) Notice: Subject to any disclaimer, the term of this patent is extended or adjusted under 35 U.S.C. 154(b) by 246 days.

(21) Appl. No.: 16/300,571

(22) PCT Filed: Dec. 13, 2016

(86) PCT No.: PCT/CN2016/109668
§ 371 (c)(1),
(2) Date: Nov. 11, 2018

(87) PCT Pub. No.: WO2017/193578
PCT Pub. Date: Nov. 16, 2017

(65) Prior Publication Data

US 2019/0203958 A1 Jul. 4, 2019

(30) Foreign Application Priority Data

May 12, 2016 (CN) ..... 201610316615.4

(51) Int. Cl.
*F24F 3/14* (2006.01)
*F24F 11/00* (2018.01)
(Continued)

(52) U.S. Cl.
CPC ..... *F24F 3/1429* (2013.01); *F24F 3/14* (2013.01); *F24F 11/0008* (2013.01); *F24F 11/65* (2018.01); *F24F 13/30* (2013.01)

(58) Field of Classification Search
CPC ..... F24F 3/1429; F24F 11/65; F24F 13/30; F24F 11/0008; F24F 3/14; F24F 3/147;
(Continued)

(56) References Cited

U.S. PATENT DOCUMENTS 7,096,684 B2 * 8/2006 Yabu ..... B01D 53/261 62/176.1
8,596,551 B2 * 12/2013 Ueda ..... F24F 3/1411 236/44 A
(Continued)

FOREIGN PATENT DOCUMENTS

EP 1901010 A1 * 3/2008 ..... F24F 13/30
EP 1672290 A4 * 10/2008 ..... F24F 3/1429
(Continued)

OTHER PUBLICATIONS

International Search Report of PCT/CN2016/109668.
(Continued)

*Primary Examiner* — Frantz F Jules
*Assistant Examiner* — Martha Tadesse
(74) *Attorney, Agent, or Firm* — Dragon Sun Law Firm, PC; Jinggao Li, Esq.

(57) ABSTRACT

The present invention provides There is provided a unitary air conditioning system with temperature and humidity loosely-coupled control and a use method. The system includes a fresh air inlet, a return air inlet, an air mixing mechanism, a front-end air guide mechanism, a first and a second heat exchangers, a back-end air guide mechanism, an air supply outlet, and an air exhaust outlet. The fresh air inlet and the return air inlet are in communication with the air
(Continued)

mixing mechanism, which is in communication with one end of an air flow passage of each of the first and the second heat exchangers through the front-end air guide mechanism; and the other ends of the air flow passages of the first and the second heat exchangers are respectively in communication with the air supply outlet and the air exhaust outlet through the back-end air guide mechanism.

15 Claims, 2 Drawing Sheets

(51) Int. Cl.
*F24F 13/30* (2006.01)
*F24F 11/65* (2018.01)

(58) Field of Classification Search
CPC .... F24F 7/08; F24F 13/20; F24F 13/10; F24F 5/001; F24F 2013/205; F24D 11/0285; Y02B 30/13
See application file for complete search history.

(56) References Cited

U.S. PATENT DOCUMENTS 8,915,451 B2 * 12/2014 Takahashi ..... F24F 3/14 236/44 A
9,470,427 B2 * 10/2016 Sakai ..... F24F 3/1429
2004/0250557 A1 * 12/2004 Yabu ..... F24F 3/1423 62/94
2006/0207429 A1 * 9/2006 Yabu ..... F24F 3/147 96/146
2010/0218534 A1 * 9/2010 Yabu ..... F24F 13/20 62/271
2010/0224688 A1 * 9/2010 Yabu ..... B01D 53/261 236/44 A
2010/0243748 A1 * 9/2010 Narikawa ..... F24F 3/1429 236/44 A
2010/0257885 A1 * 10/2010 Matsui ..... F24F 11/0008 62/271
2014/0166765 A1 * 6/2014 Takahashi ..... F24F 11/0008 236/44 A
2016/0231007 A1 * 8/2016 Ha ..... F24F 11/0001

FOREIGN PATENT DOCUMENTS

EP 2733433 A4 * 3/2015 ..... F24F 3/14
JP 2003314856 A * 11/2003 ..... F24F 3/1411
JP 3891207 B2 * 3/2007 ..... F24F 3/001
JP 4161841 B2 * 10/2008 ..... F24F 3/1411
KR 100742074 B1 * 7/2007 ..... F24F 3/065
KR 100829678 B1 * 5/2008 ..... F24F 3/1429
KR 100831555 B1 * 5/2008 ..... F24F 3/1429

OTHER PUBLICATIONS

Published International Application of PCT/CN2016/109668.
Miscellaneous documents of PCT/CN2016/109668.
Written opinion of PCT/CN2016/109668.

* cited by examiner

UNITARY AIR CONDITIONING SYSTEM WITH TEMPERATURE AND HUMIDITY COUPLED CONTROL AND METHOD OF USE

CROSS-REFERENCE TO RELATED APPLICATIONS

This application is a national stage application of PCT Application No. PCT/CN2016/109668. This application claims priority from PCT Application No. PCT/CN2016/109668, filed Dec. 13, 2016, and CN Application No. 201610316615.4, filed May 12, 2016, the contents of which are incorporated herein in the entirety by reference.

Some references, which may include patents, patent applications, and various publications, are cited and discussed in the description of the present disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

TECHNICAL FIELD

The present disclosure relates to an air conditioning apparatus, and specifically, to an air conditioning apparatus using a unitary vapor compression heat pump that use two heat and mass loosely-coupled transfer heat exchangers to independently process indoor sensible heat loads and latent heat loads, and fresh air loads.

RELATED ART

A material with a moisture absorption function may be coated on a surface of a heat exchanger to form a heat exchanger capable of processing latent heat of air efficiently. A finned tube heat exchanger in a conventional vapor compression refrigeration system is replaced with the heat exchanger whose surface is coated with a desiccant layer (hereinafter referred to as a dehumidification heat exchanger), to form a high-efficient fresh air dehumidifier (hereinafter referred to as an absorption dehumidifier). There exist the following air conditioning apparatuses, for example, Chinese patents CN 864033A and CN101171459A. That is, in a vapor compression refrigeration cycle involving multiple heat exchangers, at least one heat exchanger is a dehumidification heat exchanger, the dehumidification heat exchanger is used to regulate the humidity of air, and then other heat exchangers or other air conditioning systems are used to regulate the temperature of the air.

SUMMARY

For the defects in the prior art, the objective of the present disclosure is to provide a unitary air conditioning system with temperature and humidity loosely-coupled control. The invented unitary air conditioning system uses two same dehumidification heat exchangers to take place the coils in normal heat pump air conditioning systems. A specific feature of the dehumidification heat exchanger is that its airside heat and mass transfer is loosely-coupled, where the heat transfer between the refrigerant flowing in the tube of the dehumidification heat exchanger and the processing air flowing through the dehumidification heat exchanger depends on the temperature of the refrigerant, however the mass transfer (water vapor absorption) depends on both the refrigerant temperature and the duration of sorption process. Based on this feature, a temperature and humidity loosely-coupled control strategy is proposed to operate the invented unitary air conditioning system. Taking the cooling and dehumidification mode for example, at first, the supply air temperature will be satisfied through regulating the refrigerant temperature and then the relative humidity of the supply air will be satisfied through regulating the duration of the sorption process.

A unitary air conditioning system with temperature and humidity loosely-coupled control is provided according to the present disclosure and includes a fresh air inlet 27, a return air inlet 28, an air mixing mechanism 21, a front-end air guide mechanism 22, a first heat exchanger 13, a second heat exchanger 15, a back-end air guide mechanism 23, an air supply outlet 29, and an air exhaust outlet 30, where the fresh air inlet 27 and the return air inlet 28 are in communication with the air mixing mechanism 21; and the air mixing mechanism 21 is in communication with one end of an air flow passage of the first heat exchanger 13 and one end of an air flow passage of the second heat exchanger 15 through the front-end air guide mechanism 22; and the other end of the air flow passage of the first heat exchanger 13 and the other end of the air flow passage of the second heat exchanger 15 are respectively in communication with the air supply outlet 29 and the air exhaust outlet 30 through the back-end air guide mechanism 23.

Preferably, the system further includes an induced draft fan 25 and an exhaust fan 26, where the induced draft fan 25 is disposed between the fresh air inlet 27 and the air mixing mechanism 21; and the exhaust fan 26 is disposed between the return air inlet 28 and the air mixing mechanism 21; and the induced draft fan 25 is used to induce fresh air to the air mixing mechanism 21 from the fresh air inlet 27; and the exhaust fan 26 is used to suck return air to the air mixing mechanism from the return air inlet 28.

Preferably, the air mixing mechanism includes a first upper inlet valve 41, a first lower inlet valve 43, a second upper inlet valve 42, a second lower inlet valve 44, an upper air mixing chamber 55, and a lower air mixing chamber 56; and the fresh air inlet 27 is in communication with the upper air mixing chamber 55 through the first upper inlet valve 41; the fresh air inlet 27 is in communication with the lower air mixing chamber 56 through the first lower inlet valve 43; the return air inlet 28 is in communication with the upper air mixing chamber 55 through the second upper inlet valve 42; and the return air inlet 28 is in communication with the lower air mixing chamber 56 through the second lower inlet valve 44.

Preferably, the front-end air guide mechanism 22 includes a third upper inlet valve 51, a fourth upper inlet valve 52, a third lower inlet valve 53, and a fourth lower inlet valve 54;

the upper air mixing chamber 55 is in communication with one end of the air flow passage of the first heat exchanger 13 through the third upper inlet valve 51, and is also in communication with one end of the air flow passage of the second heat exchanger 15 through the fourth upper inlet valve 52; and the lower air mixing chamber 56 is in communication with one end of the air flow passage of the first heat exchanger 13 through the third lower inlet valve 53, and is also in communication with one end of the air flow passage of the second heat exchanger 15 through the fourth lower inlet valve 54.

Preferably, the back-end air guide mechanism 23 includes a fifth upper inlet valve 61, a sixth upper inlet valve 62, a fifth lower inlet valve 63, and a sixth lower inlet valve 64;

the other end of the air flow passage of the first heat exchanger 13 is in communication with the air supply outlet 29 through the fifth upper inlet valve 61, and is also in communication with the air exhaust outlet 30 through the sixth upper inlet valve 62; and the other end of the air flow passage of the second heat exchanger 15 is in communication with the air supply outlet 29 through the fifth lower inlet valve 63, and is in communication with the air exhaust outlet 30 through the sixth lower inlet valve 64.

Preferably, the system further includes a compressor 11, a four-way valve 12, and an expansion valve 14, where an outlet of the compressor 11 is in communication with a first inlet of the four-way valve 12; a first outlet of the four-way valve 12 in communication with an inlet of the second heat exchanger 15; and an outlet of the second heat exchanger 15 is in communication with an inlet of the first heat exchanger 13 through the expansion valve 14; and an outlet of the first heat exchanger 13 is in communication with a second inlet of the four-way valve 12; and a second outlet of the four-way valve 12 is in communication with an inlet of the compressor 11.

Preferably, the system further includes a controller 31, where the controller 31 is electrically connected to the four-way valve 12, the compressor, the first upper inlet valve 41, the first lower inlet valve 43, the second upper inlet valve 42, and the second lower inlet valve 44 of the air mixing mechanism, the third upper inlet valve 51, the fourth upper inlet valve 52, the third lower inlet valve 53, and the fourth lower inlet valve 54 of the front-end air guide mechanism 22, and the fifth upper inlet valve 61, the sixth upper inlet valve 62, the fifth lower inlet valve 63, and the sixth lower inlet valve 64 of the back-end air guide mechanism 23.

A use method of the unitary air conditioning system with temperature and humidity loosely-coupled control is provided according to the present disclosure, and the use method includes a refrigeration and dehumidification mode A, where the refrigeration and dehumidification mode A is specifically: the four-way valve 12 is not charged, the third upper inlet valve 51 and the fourth lower inlet valve 54 of the front-end air guide mechanism 22 are opened, the fourth upper inlet valve 52 and the third lower inlet valve 53 of the front-end air guide mechanism 22 are closed; the fifth upper inlet valve 61 and the sixth lower inlet valve 64 of the back-end air guide mechanism 23 are closed, and the sixth upper inlet valve 62 and the fifth lower inlet valve 64 of the back-end air guide mechanism 23 are opened;

the first heat exchanger 13 is used as an evaporator, the second heat exchanger 15 is used as a condenser; and mixed air of the upper air mixing chamber 55 enters the air flow passage of the first heat exchanger 13 through the third upper inlet valve 51 to be cooled and dehumidified to generate dry cold air;

the dry cold air enters the air supply outlet 29 through the sixth upper inlet valve 62 of the back-end air guide mechanism 23 and is delivered indoors; and mixed air of the lower air mixing chamber 56 enters the air flow passage of the second heat exchanger 15 through the fourth lower inlet valve 54 to take away heat and moisture released by the second heat exchanger 15, to generate wet hot air, and then the wet hot air enters the air exhaust outlet 30 through the fifth lower inlet valve 64, and is exhausted outdoors through the air exhaust outlet 30 after the compressor 11 is cooled.

Preferably, the system further includes a refrigeration and dehumidification mode B, where the refrigeration and dehumidification mode B is specifically:

the four-way valve 12 is charged, the fourth upper inlet valve 52 and the third lower inlet valve 53 of the front-end air guide mechanism 22 are opened, the third upper inlet valve 51 and the fourth lower inlet valve 54 of the front-end air guide mechanism 22 are closed; the sixth upper inlet valve 61 and the fifth lower inlet valve 64 of the back-end air guide mechanism 23 are closed, and the fifth upper inlet valve 62 and the sixth lower inlet valve 64 of the back-end air guide mechanism 23 are opened;

the first heat exchanger 13 is used as a condenser, the second heat exchanger 15 is used as an evaporator; and mixed air of the upper air mixing chamber 55 enters the air flow passage of the second heat exchanger 15 through the fourth upper inlet valve 52 to be cooled and dehumidified to generate dry cold air;

the dry cold air enters the air supply outlet 29 through the fifth upper inlet valve 61 of the back-end air guide mechanism 23 and is delivered indoors; and mixed air of the lower air mixing chamber 56 enters the air flow passage of the first heat exchanger 13 through the third lower inlet valve 53 to take away heat and moisture released by the first heat exchanger 13, to generate wet hot air, and then the wet hot air enters the air exhaust outlet 30 through the sixth lower inlet valve 64, and is exhausted outdoors through the air exhaust outlet 30 after the compressor 11 is cooled.

Preferably, the system further includes a heating and humidification mode A, where the four-way valve 12 is not charged, the fourth upper inlet valve 52 and the third lower inlet valve 53 of the front-end air guide mechanism 22 are opened, the third upper inlet valve 51 and the fourth lower inlet valve 54 of the front-end air guide mechanism 22 are closed; the sixth upper inlet valve 61 and the fifth lower inlet valve 64 of the back-end air guide mechanism 23 are closed, and the fifth upper inlet valve 62 and the sixth lower inlet valve 64 of the back-end air guide mechanism 23 are opened;

the first heat exchanger 13 is used as an evaporator, the second heat exchanger 15 is used as a condenser; and mixed air of the upper air mixing chamber 55 enters the air flow passage of the second heat exchanger 15 through the fourth upper inlet valve 52 to be heated and humidified to generate wet hot air;

the wet hot air enters the air supply outlet 29 through the fifth upper inlet valve 61 of the back-end air guide mechanism 23 and is delivered indoors; and mixed air of the lower air mixing chamber 56 enters the air flow passage of the first heat exchanger 13 through the third lower inlet valve 53, and after the heat and moisture are absorbed by the first heat exchanger 13, the mixed air enters the air exhaust outlet 30 through the sixth lower inlet valve 64 and is exhausted outdoors.

Preferably, the heating and humidification mode B is specifically that: the four-way valve 12 is charged, the third upper inlet valve 51 and the fourth lower inlet valve 54 of the front-end air guide mechanism 22 are opened, the fourth upper inlet valve 52 and the third lower inlet valve 53 of the front-end air guide mechanism 22 are closed; the fifth upper inlet valve 61 and the sixth lower inlet valve 64 of the back-end air guide mechanism 23 are closed, and the sixth upper inlet valve 62 and the fifth lower inlet valve 64 of the back-end air guide mechanism 23 are opened;

the first heat exchanger 13 is used as a condenser, the second heat exchanger 15 is used as an evaporator; and mixed air of the upper air mixing chamber 55 enters the air flow passage of the second heat exchanger 13 through the third upper inlet valve 51 to be heated and humidified to generate wet hot air;

the wet hot air enters the air supply outlet 29 through the sixth upper inlet valve 62 of the back-end air guide mechanism 23 and is delivered indoors; and mixed air of the lower air mixing chamber 56 enters the air flow passage of the second heat exchanger 15 through the fourth lower inlet valve 54, and after the heat and moisture are absorbed by the second heat exchanger 15, the mixed air enters the air exhaust outlet 30 through the fifth lower inlet valve 64 and is exhausted outdoors.

Compared with the prior art, the present disclosure has the following beneficial effects:

1. The present disclosure is compact in structure and small in occupation space, and has a fresh air processing capability.

2. The present disclosure is different from the foregoing system in which cooling dehumidification is used mostly during dehumidification, and in a dehumidification process of the present disclosure, because sorption or absorption dehumidification is used, the evaporation temperature is high, and the condensation temperature is reduced because water on the condenser is evaporated, the entire system has high energy efficiency.

3. The present disclosure may control the supply air temperature and the supply air humidity separately, thereby enhancing the comfort of the supply air of the air conditioning system.

4. Because of the feature, that is, the absorption effect, of the heat exchanger used in the present disclosure, when the present disclosure is heating in winter, the evaporator is not frosting, and during the heating, humidification can also be performed, thereby improving the comfort of the indoor supply air in winter.

BRIEF DESCRIPTION OF THE DRAWINGS

By reading the detailed description made to the unrestricted embodiments with reference to the accompanying drawings, other features, objectives, and advantages of the present disclosure are more obvious.

Figure 1:
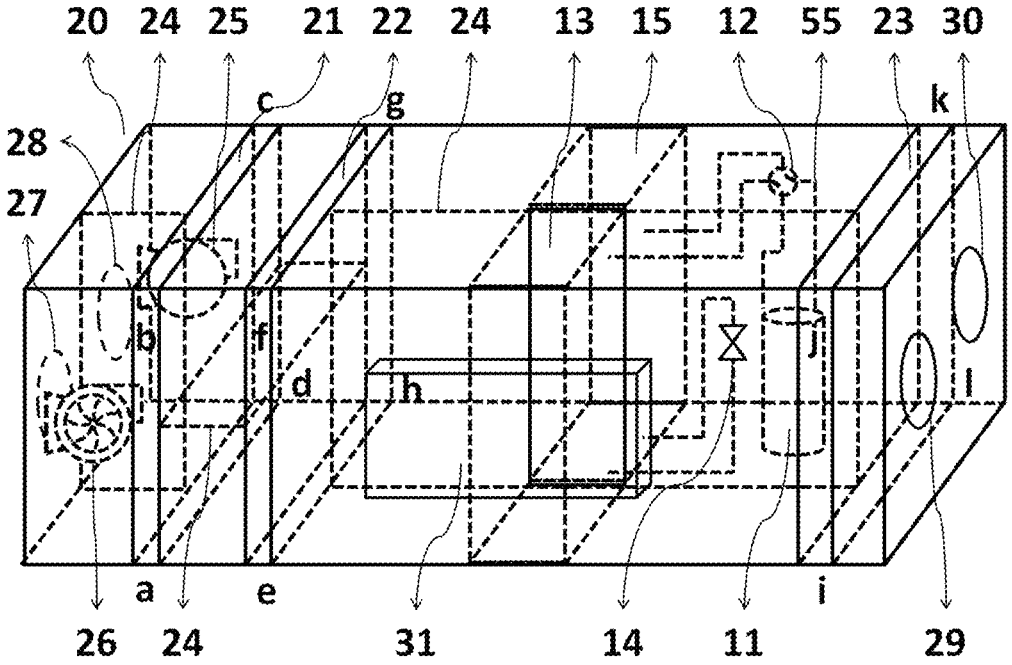
FIG. 1 is a schematic structural view of the present disclosure.
Figure 2:
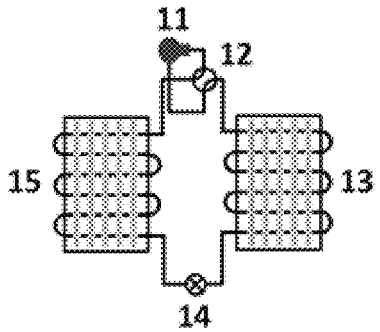
FIG. 2 is a schematic structural view of a vapor compression loop in the present disclosure.
Figure 3:
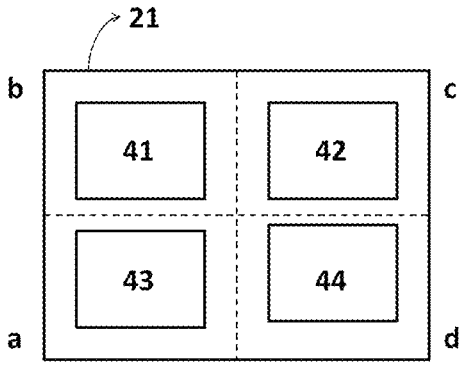
FIG. 3 is a schematic structural view of an air mixing mechanism in the present disclosure.
Figure 4:
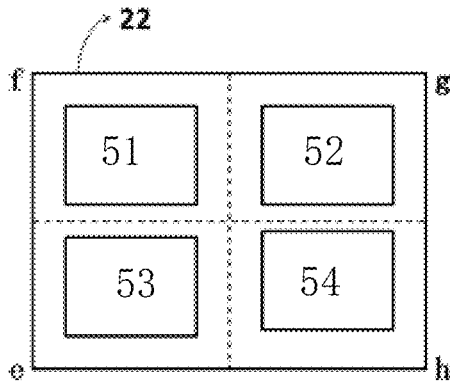
FIG. 4 is a schematic structural view of a front-end air guide mechanism in the present disclosure.
Figure 5:
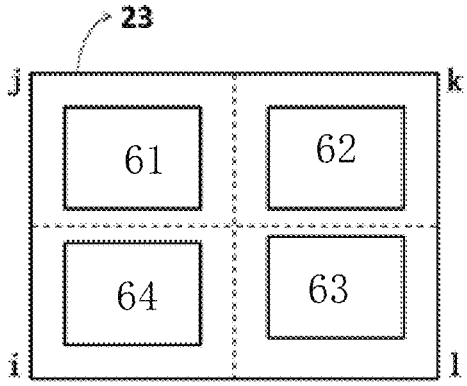
FIG. 5 is a schematic structural view of a back-end air guide mechanism in the present disclosure.

11: Compressor;
12: Four-way valve;
13: First heat exchanger;
14: Expansion valve;
15: Second heat exchanger;
20: Air passage guide mechanism;
21: Air mixing mechanism;
22: Front-end air guide mechanism;
23: Back-end air guide mechanism;
24: Air passage baffle;
25: Induced draft fan;
26: Exhaust fan;
27: Fresh air inlet;
28: Return air inlet;
29: Air supply outlet;
30: Air exhaust outlet;
31: Controller;
41: First upper inlet valve;
42: Second upper inlet valve;
43: First lower inlet valve;
44: Second lower inlet valve;
51: Third upper inlet valve;
52: Fourth upper inlet valve;
53: Third lower inlet valve;
54: Fourth lower inlet valve;
55: Pipeline;
61: Fifth upper inlet valve;
62: Sixth upper inlet valve;
63: Fifth lower inlet valve; and
64: Sixth lower inlet valve.

DETAILED DESCRIPTION

The following describes the present disclosure in detail with reference to the specific embodiments. The following embodiments help a person skilled in the art further understand the present disclosure, but do not limit the present disclosure in any form. It should be noted that, a person of ordinary skill in the art can further make several variations and improvements without departing from the idea of the present disclosure. The variations and improvements all fall within the protection scope of the present disclosure.

In this embodiment, a unitary air conditioning system with temperature and humidity loosely-coupled control provided in the present disclosure includes a fresh air inlet 27, a return air inlet 28, an air mixing mechanism 21, a front-end air guide mechanism 22, a first heat exchanger 13, a second heat exchanger 15, a back-end air guide mechanism 23, an air supply outlet 29, and an air exhaust outlet 30.

The fresh air inlet 27 and the return air inlet 28 are in communication with the air mixing mechanism 21; and the air mixing mechanism 21 is in communication with one end of an air flow passage of the first heat exchanger 13 and one end of an air flow passage of the second heat exchanger 15 through the front-end air guide mechanism 22.

The other end of the air flow passage of the first heat exchanger 13 and the other end of the air flow passage of the second heat exchanger 15 are respectively in communication with the air supply outlet 29 and the air exhaust outlet 30 through the back-end air guide mechanism 23.

The first heat exchanger 13 and the second heat exchanger 15 use a heat and mass loosely-coupled transfer heat exchanger. Inner surfaces of the air flow passages of the first heat exchanger 13 and the second heat exchanger 15 are coated with a material with a moisture absorbing function. For the unitary air conditioning system with temperature and humidity loosely-coupled control of the present disclosure, the first heat exchanger (13) and the second heat exchanger (15) are dehumidification heat exchangers coated with dehumidifier and can refrigerate and dehumidify air when used as evaporator, and can heat and humidify air when used as condenser; and wherein the heat and mass transfer process on the air side of the dehumidification heat exchanger has a characteristics of loose coupling of heat and mass transfer: the temperature of refrigerant in the dehumidification heat exchangers not only affects the heat transfer ability between dehumidification heat exchangers and the air, but also affects the moisture absorption ability of the drying agent coating on the outer side of dehumidification heat exchangers; for the drying agent coating, its moisture absorption ability depends not only on the drying agent coating, and the temperature of the refrigerant depends on the duration of a hygroscopic process.

The unitary air conditioning system with temperature and humidity loosely-coupled control provided in the present disclosure further includes an induced draft fan 25 and an exhaust fan 26.

The induced draft fan 25 is disposed between the fresh air inlet 27 and the air mixing mechanism 21; and the exhaust fan 26 is disposed between the return air inlet 28 and the air mixing mechanism 21.

The induced draft fan 25 is used to induce fresh air to the air mixing mechanism 21 from the fresh air inlet 27; and the exhaust fan 26 is used to suck return air to the air mixing mechanism from the return air inlet 28.

The air mixing mechanism includes a first upper inlet valve 41, a first lower inlet valve 43, a second upper inlet valve 42, a second lower inlet valve 44, an upper air mixing chamber 55, and a lower air mixing chamber 56.

The fresh air inlet 27 is in communication with the upper air mixing chamber 55 through the first upper inlet valve 41; the fresh air inlet 27 is in communication with the lower air mixing chamber 56 through the first lower inlet valve 43; the return air inlet 28 is in communication with the upper air mixing chamber 55 through the second upper inlet valve 42; and the return air inlet 28 is in communication with the lower air mixing chamber 56 through the second lower inlet valve 44.

The front-end air guide mechanism 22 includes a third upper inlet valve 51, a fourth upper inlet valve 52, a third lower inlet valve 53, and a fourth lower inlet valve 54.

The upper air mixing chamber 55 is in communication with one end of the air flow passage of the first heat exchanger 13 through the third upper inlet valve 51, and is also in communication with one end of the air flow passage of the second heat exchanger 15 through the fourth upper inlet valve 52.

The lower air mixing chamber 56 is in communication with one end of the air flow passage of the first heat exchanger 13 through the third lower inlet valve 53, and is also in communication with one end of the air flow passage of the second heat exchanger 15 through the fourth lower inlet valve 54.

The back-end air guide mechanism 23 includes a fifth upper inlet valve 61, a sixth upper inlet valve 62, a fifth lower inlet valve 63, and a sixth lower inlet valve 64.

The other end of the air flow passage of the first heat exchanger 13 is in communication with the air supply outlet 29 through the fifth upper inlet valve 61, and is also in communication with the air exhaust outlet 30 through the sixth upper inlet valve 62.

The other end of the air flow passage of the second heat exchanger 15 is in communication with the air supply outlet 29 through the fifth lower inlet valve 63, and is in communication with the air exhaust outlet 30 through the sixth lower inlet valve 64.

The unitary air conditioning system with temperature and humidity loosely-coupled control provided in the present disclosure further includes a compressor 11, a four-way valve 12, and an expansion valve 14.

An outlet of the compressor 11 is in communication with a first inlet of the four-way valve 12; a first outlet of the four-way valve 12 in communication with an inlet of the second heat exchanger 15; and an outlet of the second heat exchanger 15 is in communication with an inlet of the first heat exchanger 13 through the expansion valve 14.

An outlet of the first heat exchanger 13 is in communication with a second inlet of the four-way valve 12; and a second outlet of the four-way valve 12 is in communication with an inlet of the compressor 11.

The unitary air conditioning system with temperature and humidity loosely-coupled control provided in the present disclosure further includes a controller 31.

The controller 31 is electrically connected to the four-way valve 12, the compressor, the first upper inlet valve 41, the first lower inlet valve 43, the second upper inlet valve 42, and the second lower inlet valve 44 of the air mixing mechanism, the third upper inlet valve 51, the fourth upper inlet valve 52, the third lower inlet valve 53, and the fourth lower inlet valve 54 of the front-end air guide mechanism 22, and the fifth upper inlet valve 61, the sixth upper inlet valve 62, the fifth lower inlet valve 63, and the sixth lower inlet valve 64 of the back-end air guide mechanism 23.

A use method of the unitary air conditioning system with temperature and humidity loosely-coupled control provided in the present disclosure includes a refrigeration and dehumidification mode A.

The refrigeration and dehumidification mode A is specifically described that: the four-way valve 12 is not charged, the third upper inlet valve 51 and the fourth lower inlet valve 54 of the front-end air guide mechanism 22 are opened, the fourth upper inlet valve 52 and the third lower inlet valve 53 of the front-end air guide mechanism 22 are closed; the fifth upper inlet valve 61 and the sixth lower inlet valve 64 of the back-end air guide mechanism 23 are closed, and the sixth upper inlet valve 62 and the fifth lower inlet valve 64 of the back-end air guide mechanism 23 are opened.

The first heat exchanger 13 is used as an evaporator, the second heat exchanger 15 is used as a condenser; and mixed air of the upper air mixing chamber 55 enters the air flow passage of the first heat exchanger 13 through the third upper inlet valve 51 to be cooled and dehumidified to generate dry cold air.

The dry cold air enters the air supply outlet 29 through the sixth upper inlet valve 62 of the back-end air guide mechanism 23 and is delivered indoors.

Mixed air of the lower air mixing chamber 56 enters an air flow passage of the second heat exchanger 15 through the fourth lower inlet valve 54 to take away heat and moisture released by the second heat exchanger 15 to generate wet hot air, and then the wet hot air enters the air exhaust outlet 30 through the fifth lower inlet valve 64, and is exhausted outdoors through the air exhaust outlet 30 after the compressor 11 is cooled.

A use method of the unitary air conditioning system with temperature and humidity loosely-coupled control provided in the present disclosure further includes a refrigeration and dehumidification mode B.

The refrigeration and dehumidification mode B is specifically that:

the four-way valve 12 is charged, the fourth upper inlet valve 52 and the third lower inlet valve 53 of the front-end air guide mechanism 22 are opened, the third upper inlet valve 51 and the fourth lower inlet valve 54 of the front-end air guide mechanism 22 are closed; the sixth upper inlet valve 61 and the fifth lower inlet valve 64 of the back-end air guide mechanism 23 are closed, and the fifth upper inlet valve 62 and the sixth lower inlet valve 64 of the back-end air guide mechanism 23 are opened.

The first heat exchanger 13 is used as a condenser, the second heat exchanger 15 is used as an evaporator; mixed air of the upper air mixing chamber 55 enters the air flow passage of the second heat exchanger 15 through the fourth upper inlet valve 52 to be cooled and dehumidified to generate dry cold air.

The dry cold air enters the air supply outlet 29 through the fifth upper inlet valve 61 of the back-end air guide mechanism 23 and is delivered indoors.

Mixed air of the lower air mixing chamber 56 enters the air flow passage of the first heat exchanger 13 through the third lower inlet valve 53 to take away heat and moisture released by the first heat exchanger 13, to generate wet hot air, and then the wet hot air enters the air exhaust outlet 30 through the sixth lower inlet valve 64, and is exhausted outdoors through the air exhaust outlet 30 after the compressor 11 is cooled.

For the unitary air conditioning system with temperature and humidity loosely-coupled control, the characteristics of temperature and humidity loosely-coupled control are that the unitary conditioning system can independently control temperature and moisture content of wet air in the same heat exchanger, including the following steps:

Refrigeration Dehumidification Mode:

Step 1, adjust the evaporation temperature of refrigerant in the heat exchanger (evaporator) to meet the requirements of air supply temperature first.

Step 2, adjust the moisture absorption duration of the desiccant on the heat exchanger (evaporator), and then meet the requirement of moisture content in the air supply.

A use method of the unitary air conditioning system with temperature and humidity loosely-coupled control provided in the present disclosure further includes a heating and humidification mode A.

The four-way valve 12 is not charged, the fourth upper inlet valve 52 and the third lower inlet valve 53 of the front-end air guide mechanism 22 are opened, the third upper inlet valve 51 and the fourth lower inlet valve 54 of the front-end air guide mechanism 22 are closed; the sixth upper inlet valve 61 and the fifth lower inlet valve 64 of the back-end air guide mechanism 23 are closed, and the fifth upper inlet valve 62 and the sixth lower inlet valve 64 of the back-end air guide mechanism 23 are opened.

The first heat exchanger 13 is used as an evaporator, the second heat exchanger 15 is used as a condenser; and mixed air of the upper air mixing chamber 55 enters the air flow passage of the second heat exchanger 15 through the fourth upper inlet valve 52 to be heated and humidified to generate dry cold air.

The wet hot air enters the air supply outlet 29 through the fifth upper inlet valve 61 of the back-end air guide mechanism 23 and is delivered indoors.

Mixed air of the lower air mixing chamber 56 enters the air flow passage of the first heat exchanger 13 through the third lower inlet valve 53, and after the heat and moisture are absorbed by the first heat exchanger 13, the mixed air enters the air exhaust outlet 30 through the sixth lower inlet valve 64 and is exhausted outdoors.

The heating and humidification mode B is specifically that: the four-way valve 12 is charged, the third upper inlet valve 51 and the fourth lower inlet valve 54 of the front-end air guide mechanism 22 are opened, the fourth upper inlet valve 52 and the third lower inlet valve 53 of the front-end air guide mechanism 22 are closed; the fifth upper inlet valve 61 and the sixth lower inlet valve 64 of the back-end air guide mechanism 23 are closed, and the sixth upper inlet valve 62 and the fifth lower inlet valve 64 of the back-end air guide mechanism 23 are opened.

The first heat exchanger 13 is used as a condenser, the second heat exchanger 15 is used as an evaporator; and mixed air of the upper air mixing chamber 55 enters the air flow passage of the first heat exchanger 13 through the third upper inlet valve 51 to be heated and humidified to generate wet hot air.

The wet hot air enters the air supply outlet 29 through the sixth upper inlet valve 62 of the back-end air guide mechanism 23 and is delivered indoors.

Mixed air of the lower air mixing chamber 56 enters the air flow passage of the second heat exchanger 15 through the fourth lower inlet valve 54, and after the heat and moisture are absorbed by the second heat exchanger 15, the mixed air enters the air exhaust outlet 30 through the fifth lower inlet valve 64 and is exhausted outdoors.

For the unitary air conditioning system with temperature and humidity loosely-coupled control, the characteristics of temperature and humidity loosely-coupled control are that the unitary conditioning system can independently control temperature and moisture content of wet air in the same heat exchanger, including the following steps:

Heating and Humidification Mode:

Step 1: adjust the condensation temperature of refrigerant in heat exchanger (condenser) to meet the requirement of air supply temperature first.

Step 2, adjust the dehumidification duration of desiccant on heat exchanger (condenser), and then meet the requirement of moisture content in air supply.

An air pre-mixing process is: fresh air is sucked from the fresh air inlet 27 by the induced draft fan 25, and is divided into an upper air course 41 and a lower air course 43 after passing through the air mixing mechanism 21; meanwhile, return air is sucked from the return air inlet 28 by the exhaust fan 26, and is divided into an upper air course 42 and a lower air course 44 after passing through the air mixing mechanism; then the air course 41 and the air course 42 are mixed in the upper air mixing chamber 55 to form mixed air, for preparation of entering a next phase for processing and to be finally delivered indoors, and meanwhile, the air course 42 and the air course 44 are mixed in the lower air mixing chamber 56 to form mixed air, for preparation of entering a next phase for processing and to be finally exhausted outdoors.

The foregoing describes the specific embodiments of the present disclosure. It should be understood that the present disclosure is not limited to the foregoing specific implementations. A person skilled in the art may make various variations or modifications within the scope of the claims, and the variations or modifications do not affect the essential content of the present disclosure.

What is claimed is:

1. A unitary air conditioning system with temperature and humidity coupled control, comprising: a fresh air inlet (27); a return air inlet (28); an air mixing mechanism (21); a front-end aft guide mechanism (22); a first heat exchanger (13); a second heat exchanger (15); a back-end air guide mechanism (23); a four-way valve (12); a compressor (11); an aft supply outlet (29); and an aft exhaust outlet (30), wherein the fresh air inlet (27) and the return air inlet (28) are in communication with the air mixing mechanism (21); and the aft mixing mechanism (21) is in communication with a first end of an aft flow passage of the first heat exchanger (13) and a first end of an aft flow passage of the second heat exchanger (15) through the front-end air guide mechanism (22); a second-end of the air flow passage of the first heat exchanger (13) and a second end of the air flow passage of the second heat exchanger (15) are respectively in communication with the aft supply outlet (29) and the air exhaust outlet (30) through the back-end air guide mechanism (23); and the unitary air conditioning system with temperature and humidity coupled control, comprises a refrigeration and dehumidification mode A, wherein the refrigeration and dehumidification mode A is when: the four-way valve (12) is not supplied with, a third upper inlet valve (51) and a fourth lower inlet valve (54) of the front-end air guide mechanism (22) are opened, a fourth upper inlet valve (52) and a third lower inlet valve (53) of the front-end aft guide mechanism (22) are closed; a fifth upper inlet valve (61) and a sixth lower inlet valve (64) of the back-end aft guide mechanism (23) are closed, and a sixth upper inlet valve (62) and a fifth lower inlet valve (63) of the back-end air guide mechanism (23) are opened; the first heat exchanger (13) is used as an evaporator, the second heat exchanger (15) is used as a condenser; and mixed air of an upper air mixing chamber (55) of the air mixing mechanism (21) enters the first end of the air flow passage of the first heat exchanger (13) through the third upper inlet valve (51) to be cooled and dehumidified to generate dry cold air; the dry cold aft enters the aft supply outlet (29) through the sixth upper inlet valve (62) of the back-end aft guide mechanism (23) and is delivered indoors; and mixed air of the lower air mixing chamber (56) of the air mixing mechanism (21) enters the first end of the air flow passage of the second heat exchanger (15) through the fourth lower inlet valve (54) to take away heat and moisture released by the second heat exchanger (15), to generate wet hot air, and then the wet hot aft enters the air exhaust outlet (30) through the fifth lower inlet valve (64), and is exhausted outdoors through the aft exhaust cutlet (30) after the compressor (11) is cooled.

2. The unitary air conditioning system with temperature and humidity coupled control according to claim 1, further comprising:

an induced draft fan (25); and an exhaust fan (26), wherein the induced draft fan (25) is disposed between the fresh air inlet (27) and the air mixing mechanism (21); and the exhaust fan (26) is disposed between the return air inlet (28) and the air mixing mechanism (21); and the induced draft fan (25) is used to induce fresh air to the air mixing mechanism (21) from the fresh air inlet (27); and the exhaust fan (26) is used to suck return air to the air mixing mechanism from the return air inlet (28).

3. The unitary air conditioning system with temperature and humidity coupled control according to claim 2, wherein the air mixing mechanism comprises a first upper inlet valve (41), a first lower inlet valve (43), a second upper inlet valve (42), a second lower inlet valve (44), an upper air mixing chamber (55), and a lower air mixing chamber (56);

the fresh air inlet (27) is in communication with the upper air mixing chamber (55) through the first upper inlet valve (41);

the fresh air inlet (27) is in communication with the lower air mixing chamber (56) through the first lower inlet valve (43);

the return air inlet 28 is in communication with the upper air mixing chamber (55) through the second upper inlet valve (42); and the return air inlet 28 is in communication with the lower air mixing chamber (56) through the second lower inlet valve (44).

4. The unitary air conditioning system with temperature and humidity coupled control according to claim 3, wherein the front-end air guide mechanism (22) comprises a third upper inlet valve (51), a fourth upper inlet valve (52), a third lower inlet valve (53), and a fourth lower inlet valve (54);

the upper air mixing chamber (55) is in communication with the first end of the air flow passage of the first heat exchanger (13) through the third upper inlet valve (51), and is also in communication with the first end of the air flow passage of the second heat exchanger (15) through the fourth upper inlet valve (52); and the lower air mixing chamber (56) is in communication with the first end of the air flow passage of the first heat exchanger (13) through the third lower inlet valve (53), and is also in communication with the first end of the air flow passage of the second heat exchanger (15) through the fourth lower inlet valve (54).

5. The unitary air conditioning system with temperature and humidity coupled control according to claim 4, wherein the back-end air guide mechanism (23) comprises a fifth upper inlet valve (61), a sixth upper inlet valve (62), a fifth lower inlet valve (63), and a sixth lower inlet valve (64);

the second end of the air flow passage of the first heat exchanger (13) is in communication with the air supply outlet (29) through the fifth upper inlet valve (61), and is also in communication with the air exhaust outlet (30) through the sixth upper inlet valve (62); and the second end of the air flow passage of the second heat exchanger (15) is in communication with the air supply outlet (29) through the fifth lower inlet valve (63), and is also in communication with the air exhaust outlet (30) through the sixth lower inlet valve (64).

6. The unitary air conditioning system with temperature and humidity coupled control according to claim 2, further comprising:

a compressor (11);

a four-way valve (12); and an expansion valve (14), wherein an outlet of the compressor (11) is in communication with a first inlet of the four-way valve (12); a first outlet of the four-way valve (12) is in communication with an inlet of the second heat exchanger (15); and an outlet of the second heat exchanger (15) is in communication with an inlet of the first heat exchanger (13) through the expansion valve (14); and an outlet of the first heat exchanger (13) is in communication with a second inlet of the four-way valve (12); and a second outlet of the four-way valve (12) is in communication with an inlet of the compressor (11).

7. The unitary air conditioning system with temperature and humidity coupled control according to claim 6, further comprising a controller (31), wherein the controller (31) is electrically connected to the four-way valve (12), the compressor, the first upper inlet valve (41), the first lower inlet valve (43), the second upper inlet valve (42), and the second lower inlet valve (44) of the air mixing mechanism, the third upper inlet valve (51), the fourth upper inlet valve (52), the third lower inlet valve (53), and the fourth lower inlet valve (54) of the front-end air guide mechanism (22), and the fifth upper inlet valve (61), the sixth upper inlet valve (62), the fifth lower inlet valve (63), and the sixth lower inlet valve (64) of the back-end air guide mechanism (23).

8. The system according to claim 1, further comprising a refrigeration and dehumidification mode B, wherein the refrigeration and dehumidification mode B is when: the four-way valve (12) is supplied with electricity, the fourth upper inlet valve (52) and the third lower inlet valve (53) of the front-end air guide mechanism (22) are opened, the third upper inlet valve (51) and the fourth lower inlet valve (54) of the front-end air guide mechanism (22) are closed; a fifth upper inlet valve (61) and the fifth lower inlet valve (64) of the back-end aft guide mechanism (23) are closed, and the fifth upper inlet valve (62) and the sixth lower inlet valve (64) of the back-end aft guide mechanism (23) are opened; the first heat exchanger (13) is used as a condenser, the second heat exchanger (15) is used as an evaporator; and mixed aft of the upper air mixing chamber (55) enters the first end of the air flow passage of the second heat exchanger (15) through the fourth upper inlet valve (52) to be cooled and dehumidified to generate dry cold aft; the dry cold air enters the aft supply outlet (29) through the fifth upper inlet valve (61) of the back-end aft guide mechanism (23) and is delivered indoors; and mixed air of the lower aft mixing chamber (56) enters the first end of the aft flow passage of the first heat exchanger (13) through the third lower inlet valve (53) to take away heat and moisture released by the first heat exchanger (13), to generate wet hot air, and then the wet hot air enters the air exhaust outlet (30) through the sixth lower inlet valve (64), and is exhausted outdoors through the aft exhaust outlet (30) after the compressor (11) is cooled.

9. The system according to claim 1, further comprising a heating and humidification mode A, wherein the four-way valve (12) is not supplied with electricity, the fourth upper inlet valve (52) and the third lower inlet valve (53) of the front-end air guide mechanism (22) are opened, the third upper inlet valve (51) and the fourth lower inlet valve (54) of the front-end air guide mechanism (22) are closed; the sixth upper inlet valve (61) and the fifth lower inlet valve (64) of the back-end air guide mechanism (23) are closed, and the sixth upper inlet valve (62) and the sixth lower inlet valve (64) of the back-end air guide mechanism (23) are opened;

the first heat exchanger (13) is used as an evaporator, the second heat exchanger (15) is used as a condenser; and mixed air of the upper air mixing chamber (55) enters the first end of the air flow passage of the second heat exchanger (15) through the fourth upper inlet valve (52) to be heated and humidified to generate wet hot air;

the wet hot air enters the air supply outlet (29) through the fifth upper inlet valve (61) of the back-end air guide mechanism (23) and is delivered indoors; and mixed air of the lower air mixing chamber (56) enters the first end of the air flow passage of the first heat exchanger (13) through the third lower inlet valve (53), and after the heat and moisture are absorbed by the first heat exchanger (13), the mixed air enters the air exhaust outlet (30) through the sixth lower inlet valve (64) and is exhausted outdoors.

10. A unitary air conditioning system with temperature and humidity coupled control, comprising: a fresh air inlet (27); a return air inlet (28); an air mixing mechanism (21); a front-end aft guide mechanism (22); a first heat exchanger (13); a second heat exchanger (15); a back-end air guide mechanism (23); an air supply outlet (29); and an aft exhaust outlet (30), wherein the fresh aft inlet (27) and the return air inlet (28) are in communication with the aft mixing mechanism (21); and the air mixing mechanism (21) is in communication with a first end of an aft flow passage of the first heat exchanger (13) and a first end of an aft flow passage of the second heat exchanger (15) through the front-end aft guide mechanism (22); and a second-end of the air flow passage of the first heat exchanger (13) and a second end of the air flow passage of the second heat exchanger (15) are respectively in communication with the aft supply outlet (29) and the aft exhaust outlet (30) through the back-end aft guide mechanism (23), the unitary air conditioning system with temperature and humidity coupled control further comprising: an induced draft fan (25); and an exhaust fan (26), wherein the induced draft fan (25) is disposed between the fresh air inlet (27) and the air mixing mechanism (21); and the exhaust fan (26) is disposed between the return air inlet (28) and the air mixing mechanism (21); and the induced draft fan (25) is used to induce fresh air to the air mixing mechanism (21) from the fresh air inlet (27); and the exhaust fan (26) is used to suck return aft to the air mixing mechanism from the return aft inlet (28), the unitary air conditioning system with temperature and humidity coupled control further comprising a refrigeration and dehumidification mode A, wherein the refrigeration and dehumidification mode A is when: the four-way valve (12) is not supplied with electricity, the third upper inlet valve (51) and the fourth lower inlet valve (54) of the front-end aft guide mechanism (22) are opened, the fourth upper inlet valve (52) and the third lower inlet valve (53) of the front-end air guide mechanism (22) are closed; the fifth upper inlet valve (61) and the sixth lower inlet valve (64) of the back-end air guide mechanism (23) are closed, and the sixth upper inlet valve (62) and the fifth lower inlet valve (64) of the back-end air guide mechanism (23) are opened; the first heat exchanger (13) is used as an evaporator, the second heat exchanger (15) is used as a condenser; and mixed air of the upper aft mixing chamber (55) enters the first end of the aft flow passage of the first heat exchanger (13) through the third upper inlet valve (51) to be cooled and dehumidified to generate dry cold aft; the dry cold air enters the air supply outlet (29) through the sixth upper inlet valve (62) of the back-end aft guide mechanism (23) and is delivered indoors; and mixed aft of the lower aft mixing chamber (56) enters the first end of the air flow passage of the second heat exchanger (15) through the fourth lower inlet valve (54) to take away heat and moisture released by the second heat exchanger (15), to generate wet hot air, and then the wet hot aft enters the aft exhaust outlet (30) through the fifth lower inlet valve (64), and is exhausted outdoors through the air exhaust outlet (30) after the compressor (11) is cooled.

11. The unitary air conditioning system with temperature and humidity coupled control according to claim 10, wherein the air mixing mechanism comprises a first upper inlet valve (41), a first lower inlet valve (43), a second upper inlet valve (42), a second lower inlet valve (44), an upper air mixing chamber (55), and a lower air mixing chamber (56);

the fresh air inlet (27) is in communication with the upper air mixing chamber (55) through the first upper inlet valve (41);

the fresh air inlet (27) is in communication with the lower air mixing chamber (56) through the first lower inlet valve (43);

the return air inlet 28 is in communication with the upper air mixing chamber (55) through the second upper inlet valve (42); and the return air inlet 28 is in communication with the lower air mixing chamber (56) through the second lower inlet valve (44).

12. The unitary air conditioning system with temperature and humidity coupled control according to claim 11, wherein the front-end air guide mechanism (22) comprises a third upper inlet valve (51), a fourth upper inlet valve (52), a third lower inlet valve (53), and a fourth lower inlet valve (54);

the upper air mixing chamber (55) is in communication with the first end of the air flow passage of the first heat exchanger (13) through the third upper inlet valve (51), and is also in communication with the first end of the air flow passage of the second heat exchanger (15) through the fourth upper inlet valve (52); and the lower air mixing chamber (56) is in communication with the first end of the air flow passage of the first heat exchanger (13) through the third lower inlet valve (53), and is also in communication with the first end of the air flow passage of the second heat exchanger (15) through the fourth lower inlet valve (54).

13. The unitary air conditioning system with temperature and humidity coupled control according to claim 12, wherein the back-end air guide mechanism (23) comprises a fifth upper inlet valve (61), a sixth upper inlet valve (62), a fifth lower inlet valve (63), and a sixth lower inlet valve (64);

the second end of the air flow passage of the first heat exchanger (13) is in communication with the air supply outlet (29) through the fifth upper inlet valve (61), and is also in communication with the air exhaust outlet (30) through the sixth upper inlet valve (62); and the second end of the air flow passage of the second heat exchanger (15) is in communication with the air supply outlet (29) through the fifth lower inlet valve (63), and is also in communication with the air exhaust outlet (30) through the sixth lower inlet valve (64).

14. The unitary air conditioning system with temperature and humidity coupled control according to claim 13, wherein the unitary air conditioning system with temperature and humidity coupled control further comprises:

a compressor (11);

a four-way valve (12); and an expansion valve (14), wherein an outlet of the compressor (11) is in communication with a first inlet of the four-way valve (12); a first outlet of the four-way valve (12) is in communication with an inlet of the second heat exchanger (15); and an outlet of the second heat exchanger (15) is in communication with an inlet of the first heat exchanger (13) through the expansion valve (14); and an outlet of the first heat exchanger (13) is in communication with a second inlet of the four-way valve (12); and a second outlet of the four-way valve (12) is in communication with an inlet of the compressor (11).

15. The unitary air conditioning system with temperature and humidity coupled control according to claim 14, wherein the controller (31) is electrically connected to the four-way valve (12), the compressor, the first upper inlet valve (41), the first lower inlet valve (43), the second upper inlet valve (42), and the second lower inlet valve (44) of the air mixing mechanism, the third upper inlet valve (51), the fourth upper inlet valve (52), the third lower inlet valve (53), and the fourth lower inlet valve (54) of the front-end air guide mechanism (22), and the fifth upper inlet valve (61), the sixth upper inlet valve (62), the fifth lower inlet valve (63), and the sixth lower inlet valve (64) of the back-end air guide mechanism (23).

* * * * *